US005259291A

United States Patent [19]

Wilson

[11] Patent Number: 5,259,291

[45] Date of Patent: Nov. 9, 1993

[54] TRAP FOR HIGH VELOCITY BULLETS

[76] Inventor: Richard M. Wilson, P.O. Box 901, Orr Rd., Galt, Calif. 95632

[21] Appl. No.: 861,285

[22] Filed: Mar. 31, 1992

[51] Int. Cl.[5] ..... F41J 1/14

[52] U.S. Cl. ..... 89/36.02; 273/410

[58] Field of Search ..... 89/36.02; 273/410, 404, 273/408

[56] References Cited

U.S. PATENT DOCUMENTS

| | | | |
|---|---|---|---|
| 840,610 | 1/1907 | Easdale | 273/404 |
| 2,013,133 | 9/1935 | Coswell | 273/410 |
| 2,420,304 | 5/1947 | Diem | 273/410 |
| 3,701,532 | 10/1972 | Nikoden | 273/410 |
| 4,126,311 | 11/1978 | Wagoner | 273/410 |
| 4,512,585 | 4/1985 | Baravaglio | 273/410 |
| 4,821,620 | 4/1989 | Cartec et al. | 89/36.02 |
| 5,070,763 | 12/1991 | Coburn | 89/36.02 |

FOREIGN PATENT DOCUMENTS

| | | | |
|---|---|---|---|
| 3308664 | 9/1984 | Fed. Rep. of Germany | 273/410 |
| 0214433 | 10/1984 | Fed. Rep. of Germany | 273/410 |
| A.D.6353 | of 1909 | United Kingdom | 273/410 |
| 547538 | 9/1942 | United Kingdom | 273/410 |

*Primary Examiner*—David H. Brown

*Attorney, Agent, or Firm*—Catalano, Zingerman & McKay

[57] ABSTRACT

A trap for receiving a projectile travelling along a substantially horizontal axis of travel at high velocity includes a pair of side walls, and primary, secondary and tertiary deflecting plates. The primary plate obliquely intersects the axis of travel of the projectile to downwardly deflect the projectile or particles thereof to approximately a second axis of travel. The secondary plate obliquely intersects the second axis of travel to further downwardly deflect the projectile or particles thereof to approximately a third axis of travel. The tertiary pate obliquely intersects the third axis of travel to further downwardly deflect the projectile or particles thereof to approximately a fourth axis of travel. Each deflection shows particle velocity. A bottom surface extends below the plates so that the plates, the sides and the bottom surface define a rectangular mouth for receiving the projectile and a chamber for containing the projectile or particles thereof. In another embodiment of the invention, a second primary plate slopes upwardly in relation to the first path of travel and has a leading edge substantially vertically aligned below the primary plate leading edge and a trailing edge forward of and at or above the level of the primary plate trailing edge. The second primary plate affords a trap of significantly less depth than the trap without such a plate for traps having substantially the same size rectangular mouth. In either embodiment, a tray along the back of the trap collects the trapped projectile or particles thereof.

19 Claims, 2 Drawing Sheets

TRAP FOR HIGH VELOCITY BULLETS

BACKGROUND OF THE INVENTION

This invention relates generally to bullet traps and more particularly concerns traps capable of containing bullets traveling at speeds in excess of 3,000 feet per second with or without full or partial steel jackets as well as lead or steel pellets. Bullet traps capable of containing bullets traveling at speeds slower than 3,000 feet per second are well known. These traps, however, are incapable of containing bullets traveling at speeds greater than 3,000 feet per second without at least significant damage to the trap components impacted by the bullets. Once the steel plate of the trap is nicked, subsequent bullets impacting in the nicked area cause highly erratic distribution of particles within the trap and rapidly deteriorate the plate as well as the backing curtain supporting the targets. The frequent repair or replacement of the components of the trap is cost and time prohibitive.

It is therefore an object of this invention to provide a bullet trap capable of containing bullets traveling at high velocity. It is a further object of this invention to provide a bullet trap capable of containing bullets traveling at high velocity with minimal damage to the components of the trap.

SUMMARY OF THE INVENTION

In accordance with one embodiment of the invention, a trap for receiving a projectile travelling along a substantially horizontal axis of travel at high velocity includes a pair of side walls, and primary, secondary and tertiary deflecting plates. The primary plate obliquely intersects the axis of travel of the projectile to downwardly deflect the projectile or particles thereof to approximately a second axis of travel and to slow their velocity.

The secondary plate obliquely intersects the second axis of travel to further downwardly deflect the projectile or particles thereof to approximately a third axis of travel and to further slow their velocity.

The tertiary plate obliquely intersects the third axis of travel to further downwardly deflect the projectile or particles thereof to approximately a fourth axis of travel and to further slow their velocity.

A bottom surface extends below the plates so that the plates, the sides and the bottom surface define a rectangular mouth for receiving the projectile and a chamber for containing the projectile or particles thereof.

In another embodiment of the invention, a second primary plate slopes upwardly in relation to the first path of travel and has a leading edge substantially vertically aligned below the primary plate leading edge and a trailing edge forward of and at or above the level of the primary plate trailing edge.

The second primary plate affords a trap of significantly less depth than the trap without such a plate for traps having substantially the same size rectangular mouth.

In either embodiment, a tray along the back of the trap collects the trapped projectile or particles thereof.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
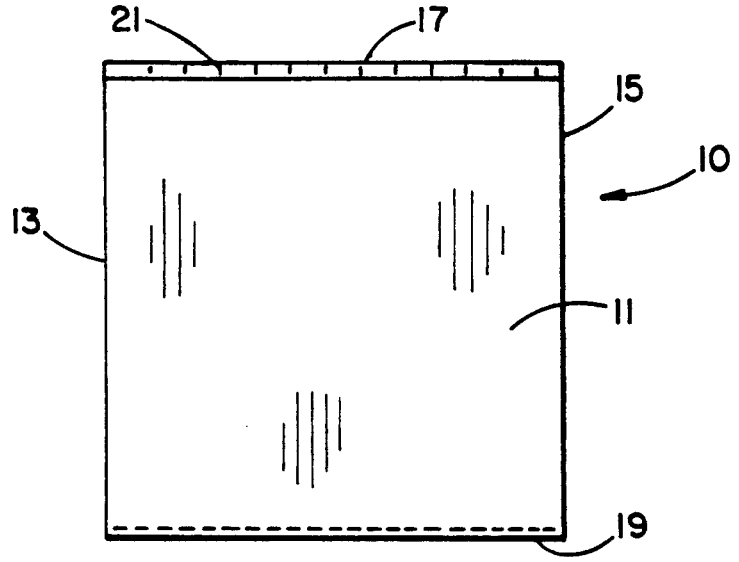
FIG. 1 is a front elevation view illustrating a target mounting curtain covering the mouth of a bullet trap.

Turning first to FIG. 1, the target face 10 of a typical bullet trap is illustrated for use in conjunction with a preferred embodiment of the present trap for high velocity bullets. The target face 10 generally consists of a backing curtain 11 formed generally of a flexible, self-sealing, rubber-like material in a rectangular configuration having side edges 13 and 15 and top and bottom edges 17 and 19. A typical backing curtain 11 may be 40 inches high by 96 inches wide, but a wide variety of dimensions is 10 possible. The top edge 17 of the backing curtain 11 is typically secured to the top of the bullet trap by a plurality of bolts 21.

Figure 2:
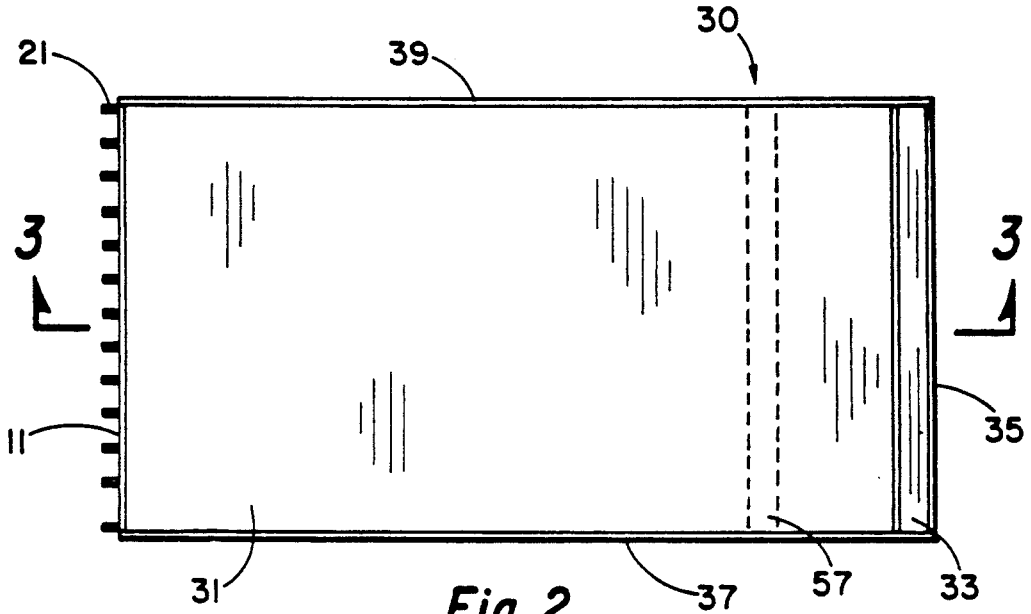
FIG. 2 is a top plan view of a preferred embodiment of the bullet trap.
Figure 3:
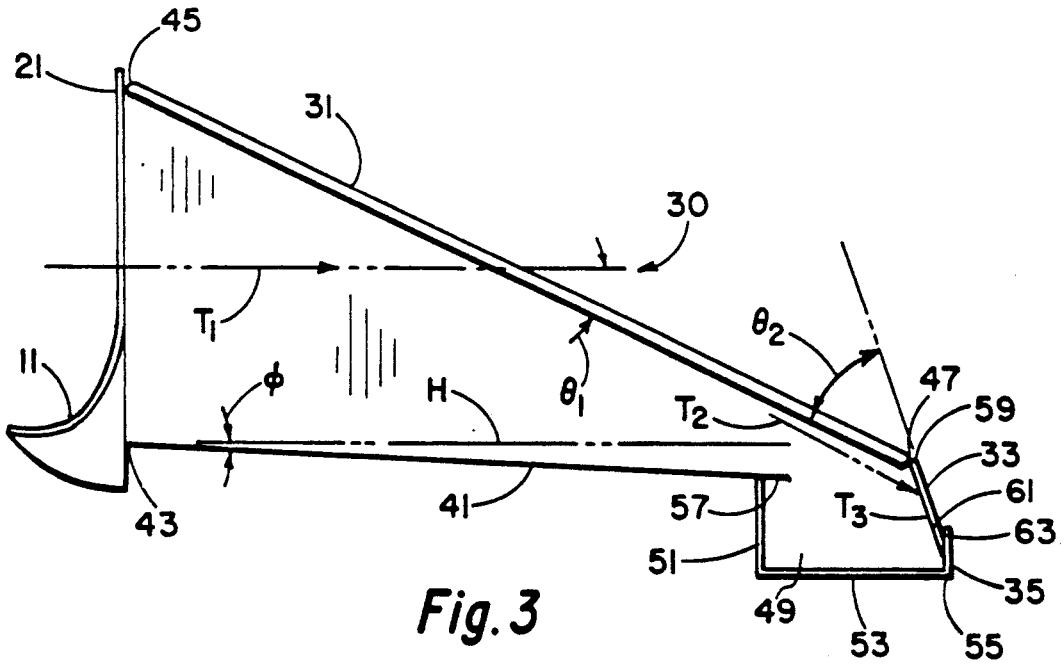
FIG. 3 is a cross-sectional view taken along the line 3—3 of FIG. 2.

Turning to FIGS. 2 and 3, a deep embodiment 30 of the bullet trap is illustrated. The trap 30 consists of a primary plate 31, a secondary plate 33 and a tertiary plate 35 disposed between a pair of side walls 37 and 39.

The primary plate 31 is obliquely disposed in relation to the approximate anticipated axis of travel $T_1$ of the projectile through the backing curtain 11. Preferably, the plate 31 is at an angle $\theta_1$ of approximately 25 degrees. If the angle $\theta_1$ is increased above 25 degrees, greater damage may occur to the primary plate 31 on impact of a high velocity projectile. If the angle $\theta_1$ is decreased below 25 degrees, the effectiveness of the plate 31 to deflect the projectile and slow its velocity is diminished. Typically, the primary plate 31 will be of one inch thick abrasion resistant steel. When used with an approximately forty inch high target mouth, the primary plate may be approximately 96 inches long by 96 inches wide.

The secondary plate 33 is disposed at an angle $\theta_2$ in relation to the primary plate 31. Preferably, $\theta_2$ is approximately 45 degrees. Thus, the secondary plate 33 is at an oblique angle to a second axis of travel $T_2$ resulting from a deflection of the projectile or particles thereof by the primary plate 31. In the embodiment shown, the secondary plate 33 may preferably be made of ½ inch thin mild steel and approximately 8 inches long by 96 inches wide.

The tertiary plate 35 is disposed at substantially right angles to the original path of travel $T_1$ of the projectile and is therefore also obliquely disposed in relation to a third axis of travel $T_3$ of the projectile or particles thereof resulting from the deflection of the projectile or particles thereof by the secondary plate 33. In the embodiment shown, the tertiary plate 35 may consist of ⅛ inch skin steel approximately 6 inches long and 96 inches wide.

As can best be seen in FIG. 3, the bullet trap 30 may also include a bottom surface 41 extending from the front of the trap 30 from a point 43 below and vertically aligned with the leading edge 45 of the primary plate 31. Furthermore, the point 43 is at or preferably above the level of the trailing edge 47 of the primary plate 31. Thus, all projectiles entering through the backing curtain 11 into the trap 30 must first strike the primary plate 31 before striking the secondary plate 33 or tertiary plate 35. The surface 41 will preferably be downwardly inclined from the horizontal H by an angle $\phi$ of approximately 4 degrees. As a result, particles coming to rest on the surface 41 will be gravitationally fed toward the rear of the trap 30.

At the rear of the trap 30, a tray 49 is provided which consists of a vertical wall 51 extending downwardly from the surface 41 and a base portion 53 extending substantially horizontally between the vertical wall 51 and the trailing edge 55 of the tertiary plate 35. Thus, the projectiles or particles thereof captured by the trap 30 are ultimately stored in the tray 49. In the preferred embodiment illustrated, the base 53 of the trap will be approximately 22 inches long. As is also shown in this preferred embodiment, the surface 41 extends beyond the vertical wall 51 for a distance 57 which may typically be approximately 3 inches. This overhang 57 of the tray 49 helps to prevent ricocheting projectiles or particles thereof from escaping the tray 49 and being reintroduced into the trap.

As can be seen in FIG. 3, the trailing edge 47 of the primary plate 31 butts the leading edge 59 of the secondary plate 33 and the trailing edge 61 of the secondary plate 33 abuts the leading or top edge 63 of the tertiary plate 35. Thus, it can be seen that the plate 31, 33 and 35 together with the bottom surface 41 and the tray 49, along with the sidewalls 13 and 15, define a rectangular mouth for receiving a projectile in the chamber and for containing the projectile or particles thereof. This chamber is sealed by a backing curtain 11 to totally contain the projectile or the particles thereof.

In operation, when a projectile is fired into the trap 30, it first encounters the primary plate 31 at an angle of approximately 25 degrees. This impact is generally sufficient to separate the steel jacket of the projectile from the lead and to redirect the projectile or particles thereof along a second axis of travel at a slower velocity. The velocity of some particles may be sufficiently slowed as to permit them to settle on the bottom surface 41. A projectile or particles thereof continuing approximately along the second axis of travel $T_2$ will impact the secondary plate 33 and be further disintegrated and the projectile or portions or particles thereof redirected along approximately the third axis of travel $T_3$ to the tertiary plate 35. The projectile or particles thereof may be further sufficiently slowed at this point to settle into the tray 49 rather than impact the tertiary plate 35. Those projectiles or particles thereof which find their way along the third axis of travel $T_3$ to the tertiary plate 35 are again deflected, disintegrated and slowed by the tertiary plate 35 to the extent that the entire projectile or particles thereof may be fully contained in the trap. As previously mentioned, the overhang 57 assists in preventing particles that have entered the tray 49 from escaping therefrom. Finally, the projectile or particles thereof settling on the surface 41 are gravitated into the tray 49 where they are stored until removal.

Figure 4:
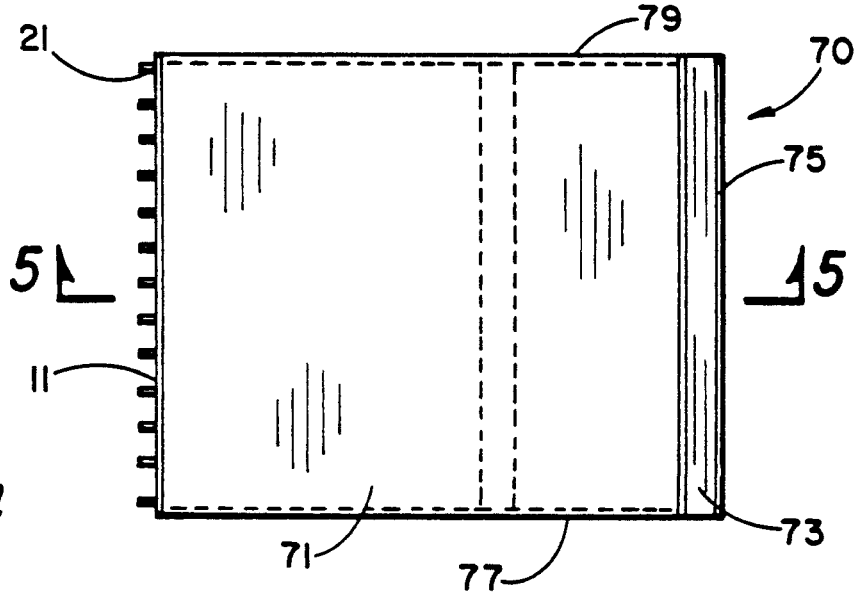
FIG. 4 is a top plan view of another preferred embodiment of the bullet trap.
Figure 5:
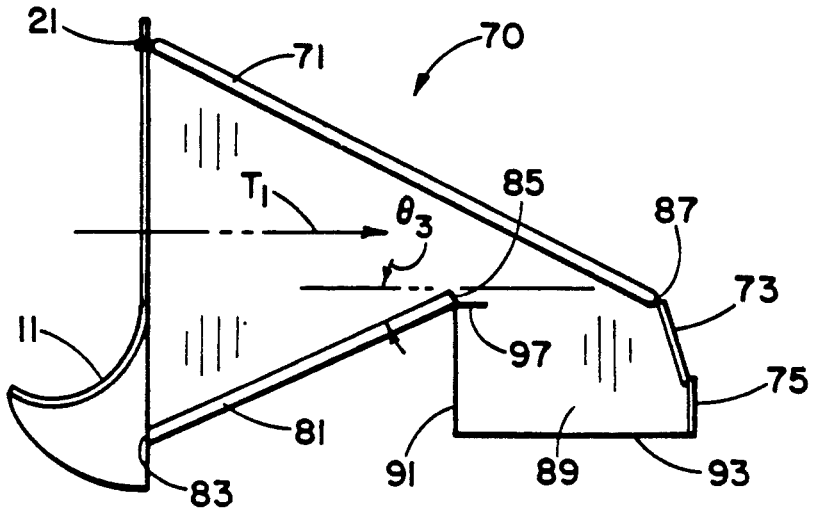
FIG. 5 is a cross-sectional view taken along the line 5—5 of FIG. 4.

Turning now to FIGS. 4 and 5, a shallow embodiment 70 of the bullet trap is illustrated. The shallow trap 70 is in many respects similar to the deep trap 30. The primary plate 71 extends from the backing curtain 11 to a secondary plate 73 which in turn extends to a tertiary plate 75, all between sidewalls 77 and 79. The relationship of these plates 71, 73 and 75 is angularly and dimensionally similar to that of the plates 31, 33 and 35 described in relation to FIG. 3, except that the primary plate 71 as shown in the shallow embodiment 70 is approximately $\frac{2}{3}$ the length of the plate 31 of the deep embodiment 30. However, a second primary plate 81 approximately $\frac{1}{3}$ the length of the primary plate 31 of the deep embodiment 30 is used in the shallow embodiment 70. In one typical application a 96 inch plate is cut into 60 inch and 30 inch sections to form the first and second primary plates. This second primary plate 81 has a leading edge 83 which extends obliquely in relation to the axis of travel $T_1$ of the projectile at an angle $\theta_3$ of approximately 25 degrees from the axis of travel $T_1$ of the projectile opposite to the angle $\theta_1$ between the first primary plate 71 and the axis of travel $T_1$ of the projectile. This second primary plate 81 extends to a trailing edge 85 which is at or above the level of the trailing edge 87 of the first primary plate 71. Thus, projectiles entering through the backing curtain 11 into the trap 70 may strike the primary plate 71 and be captured according to the operation disclosed in relation to the deep embodiment 30 of the trap or the projectile may first strike the second primary plate 81 and be deflected from there to the first primary plate 71 for further containment in the trap 70. In the shallow embodiment 70, the tray 89 will have a vertical wall 91 and a base portion 93 completing the trap enclosure. For a trap of approximately those dimensions hereinbefore given, the base portion 93 will be approximately 27 inches long. An overhanging flange 97 may also be provided to assure that projectiles or particles thereof entering into the tray 89 may not escape into other portions of the trap 70.

Given target faces 10 which are substantially the same, the us of the second primary plate 81 results in a trap of considerable less depth than a trap not using this plate.

It will be apparent that variations in the materials, the thickness of materials and the overall dimensions of the trap may be varied to suit particular applications, provided the significant angular relationships of the component parts is maintained. It will be further noted that this trap, designed to accommodate projectile traveling at speeds in excess of 3,000 feet per second, will also be capable of handling projectiles traveling at significantly lower speeds. And it will be apparent that the trap can be inverted or mounted at any other desired angle provided the tray is located at the bottom of the trap.

Thus, it is apparent that there has been provided, in accordance with the invention, a trap for high velocity bullets that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A trap for receiving a projectile travelling along an axis of travel at high velocity in the range of 3,000 feet per second and above comprising:

a rectangular mouth;

a primary plate having a leading edge defining an upper limit of said mouth, said primary plate obliquely intersecting said axis of travel for deflecting said projectile or particles thereof to approximately a second axis of travel and for slowing the rate of travel thereof;

a secondary plate obliquely intersecting said second axis of travel for deflecting said projectile or particles thereof to approximately a third axis of travel and for further slowing the rate of travel thereof;

a tertiary plate obliquely intersecting said third axis of travel for deflecting said projectile or particles thereof to approximately a fourth axis of travel and for further slowing the rate of travel thereof, and a substantially flat surface having a leading edge defining a lower limit of said mouth and extending below said primary plate and sloping downwardly in relation to said axis of travel;

whereby said projectile or particles thereof are slowed to substantially a stop by said plates and gravitated toward said tertiary plate by said substantially flat surface.

2. A trap according to claim 1, said axis of travel being substantially horizontal, said primary and secondary plates sloping downwardly in relation to said path of travel and said tertiary plate being substantially perpendicular to said path of travel.

3. A trap according to claim 2 further comprising a second primary plate sloping upwardly in relation to said path of travel and having a leading edge below and substantially vertically aligned with a leading edge of said primary plate and a trailing edge at or above the level of a trailing edge of said tertiary plate.

4. A trap according to claim 3, said primary plate and said second primary plate being at approximately a 25 degree angles in relation to said axis of travel and said secondary plate being at approximately a 45 degree angle in relation to said primary plate.

5. A trap according to claim 4 further comprising a tray means extending between said tertiary plate and said trailing edge of said second primary plate for receiving and storing said projectile or particles thereof.

6. A trap according to claim 5, said primary plate being approximately 60" long, said secondary plate being approximately 8" long, said tertiary plate being approximately 6" long and said second primary plate being approximately 36" long.

7. A trap according to claim 6, said tray means having a substantially vertical front wall extending downwardly from said trailing edge of said second primary plate and a base extending substantially horizontally from a bottom edge of said front wall to a bottom edge of said tertiary plate.

8. A trap according to claim 7, said base being approximately 27" long.

9. A trap according to claim 2, said primary plate being at approximately a 25 degree angle in relation to said axis of travel and said secondary plate being at approximately a 45 degree angle in relation to said primary plate.

10. A trap according to claim 9 further comprising a tray means extending between said tertiary plate and said sloping substantially flat surface for receiving and storing said projectile or particles thereof gravitated thereto by said sloping surface.

11. A trap according to claim 10, said primary plate being approximately 96" long, said secondary plate being approximately 8" long and said tertiary plate being approximately 6" long.

12. A trap according to claim 11, said sloping surface having a leading edge below and substantially vertically aligned with a leading edge of said primary plate and above a trailing edge of said primary plate.

13. A trap according to claim 12, said sloping surfaces being at an angle of approximately 4 degrees.

14. A trap according to claim 13, said tray means having a substantially vertical front wall extending downwardly from a trailing edge of said sloping surface and a base extending substantially horizontally from a bottom edge of said front wall to a bottom edge of said tertiary plate.

15. A trap according to claim 14, said base being approximately 22" long.

16. A trap for receiving a projectile travelling along a substantially horizontal axis of travel at high velocity in the range of 3,000 feet per second and above comprising:

a pair of side walls;

a primary plate between said side walls having leading and trailing edges and obliquely intersecting said axis of travel for downwardly deflecting said projectile or particles thereof to approximately a second axis of travel and for slowing said velocity thereof;

a secondary plate between said side walls having leading and trailing edges and obliquely intersecting said second axis of travel for further downwardly deflecting said projectile or particles thereof to approximately a third axis of travel and for further slowing said velocity thereof, said leading edge of said secondary plate abutting said trailing edge of said primary plate;

a tertiary plate between said side walls having top and bottom edges and obliquely intersecting said third axis of travel for further downwardly deflecting said projectile or particles thereof to approximately a fourth axis of travel and for further slowing said velocity thereof, said top edge of said tertiary plate abutting said trailing edge of said secondary plate; and a bottom surface between said side walls having leading and trailing edges, said bottom surface leading edge being substantially vertically aligned below said primary plate leading edge and said bottom surface trailing edge above the level of said tertiary plate bottom edge, said primary plate leading edge, said sides and said bottom surface leading edge defining a rectangular mouth for receiving said projectile.

17. A trap according to claim 16, said bottom surface sloping downwardly in relation to said axis of travel for gravitating said received projectile or particles thereof toward said tertiary plate.

18. A trap according to claim 17, said bottom surface further comprising a tray means extending between said tertiary plate and said sloping surface for receiving and storing said projectile or particles thereof gravitated thereto by said sloping surface.

19. A trap for receiving a projectile travelling along a substantially horizontal axis of travel at high velocity in the range of 3,000 feet per second and above comprising:

a pair of side walls;

a primary plate between said side walls having leading and trailing edges and obliquely intersecting said axis of travel for downwardly deflecting said projectile or particles thereof to approximately a second axis of travel and for slowing said velocity thereof;

a secondary plate between said side walls having leading and trailing edges and obliquely intersecting said second axis of travel for further downwardly deflecting said projectile or particles thereof to approximately a third axis of travel and for further slowing said velocity thereof, said leading edge of said secondary plate abutting said trailing edge of said primary plate;

a tertiary plate between said side walls having top and bottom edges and obliquely intersecting said third axis of travel for further downwardly deflecting said projectile or particles thereof to approximately a fourth axis of travel and for further slowing said velocity thereof, said top edge of said tertiary plate abutting said trailing edge of said secondary plate;

a second primary plate between said side walls sloping upwardly in relation to said path of travel and having leading and trailing edges, said second primary plate leading edge being substantially vertically aligned below said primary plate leading edge and said second primary plate trailing edge being forward of and at or above the level of said primary plate trailing edge; and tray means between said side walls having a substantially vertical front wall extending downwardly from said trailing edge of said second primary plate and a base extending substantially horizontally from a bottom edge of said front wall to said bottom edge of said tertiary plate;

said primary plate leading edge, said sides and said bottom surface leading edge defining a rectangular mouth for receiving said projectile.

* * * * *